US005917525A

United States Patent [19]

Butty

[11] Patent Number: 5,917,525

[45] Date of Patent: Jun. 29, 1999

[54] INK CARTRIDGE FOR A PRINT HEAD OF AN INK-JET PRINTER

[75] Inventor: Rene Butty, Hinwil, Switzerland

[73] Assignee: Pelikan Produktions AG, Zurich, Switzerland

[21] Appl. No.: 08/740,428

[22] Filed: Oct. 29, 1996

[30] Foreign Application Priority Data

| | | | |
|---|---|---|---|
| Oct. 30, 1995 | [DE] | Germany | 195 40 461 |
| May 1, 1996 | [DE] | Germany | 196 18 986 |

[51] Int. Cl.[6] ..... B41J 2/175

[52] U.S. Cl. ..... 347/86

[58] Field of Search ..... 347/85, 86, 87

[56] References Cited

U.S. PATENT DOCUMENTS

| | | | |
|---|---|---|---|
| 4,967,207 | 10/1990 | Ruder | 347/87 |
| 4,968,998 | 11/1990 | Allen | 347/87 |
| 5,555,238 | 9/1996 | Miyazawa | 347/86 |
| 5,574,489 | 11/1996 | Cowger et al. | 347/86 |
| 5,576,749 | 11/1996 | Mochizuki et al. | 347/86 |
| 5,633,667 | 5/1997 | Miyazawa | 347/86 |

FOREIGN PATENT DOCUMENTS

| | | |
|---|---|---|
| 0547874A2 | 6/1993 | European Pat. Off. . |
| 0560729A2 | 9/1993 | European Pat. Off. . |
| 0631875A2 | 1/1995 | European Pat. Off. . |
| 0655335A2 | 5/1995 | European Pat. Off. . |
| 4344746A1 | 6/1995 | Germany . |

OTHER PUBLICATIONS

Replaceable Ink Cartridge for Ink Jet Print Head; IBM Technical Disclosure Bulletin; pp. 459–462 Jun. 1991.

*Primary Examiner*—Benjamin R. Fuller
*Assistant Examiner*—Craig A. Hallacher
*Attorney, Agent, or Firm*—Fay, Sharpe, Beall, Fagan, Minnich & McKee

[57] ABSTRACT

The ink cartridge comprises a housing with a housing bottom (11) which has an opening for placement onto a stub feed tube of a print head. At the lower edge the opening (15), there is a radially inward projecting sealing lip (24) which is pressed elastically against a cylindrical element (27) of a transport guard (2). Between the cylindrical element (27) and lip (24), there is formed a capillary sealing gap which expands in the downward direction. An annular recess (36) which narrows toward the recess bottom, and a capillary gap (35) form additional steps of a capillary seal. The air supply opening in the housing lid is also sealed by means of a multi-step capillary seal against the escape of ink. This facilitates economical production.

14 Claims, 4 Drawing Sheets

1
12
10
11
17
14
13
38
2

35
11
34
24
17
33
36
37
27
15
28
2

11
17
35
33
36
15
24
25
29
28
27

VII 54
53
52
49
48
46
40
45
47
50
51
13
41
42
44
43
17
1

54
52
49
48
46
45
40
47
50
51
53

INK CARTRIDGE FOR A PRINT HEAD OF AN INK-JET PRINTER

BACKGROUND OF THE INVENTION

The invention is directed to an ink cartridge for a print head of an ink-jet printer and, more particularly, to such a cartridge having a transport guard.

SUMMARY OF THE INVENTION

An ink cartridge is known, for example, from EP-A-560 729. The housing of this prior cartridge contains an ink impregnated foam body and has an opening for mounting onto a stub or feed tube of a print head and a second, smaller opening for the supply of air. In one exemplary embodiment, the transport guard consists of a foil strip sealed over the openings.

Other ink cartridges of this type are known through prior use, where the transport guard is made of plastic material, for example an O-ring or an elastomer strip, which is pressed against a sealing lip of the cartridge housing.

The present invention is based on the object of further refining such ink cartridges in such manner that they can be manufactured more economically. Said object is solved by means of the combined characteristics of the claims.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
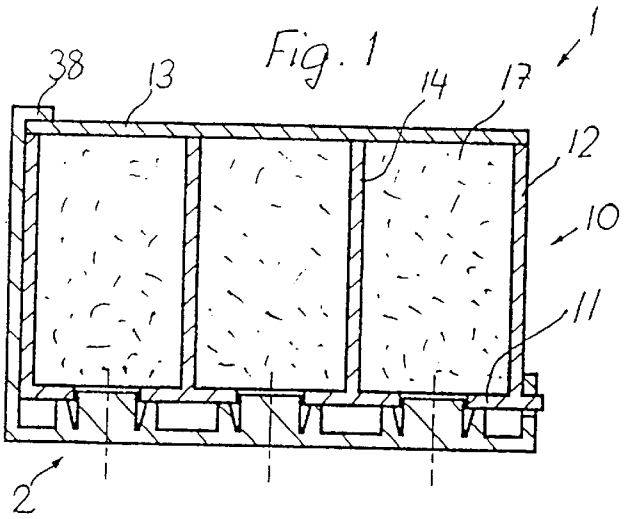
FIG. 1 shows a cross section through a cartridge formed in accordance with a first embodiment of the invention.
Figure 2:
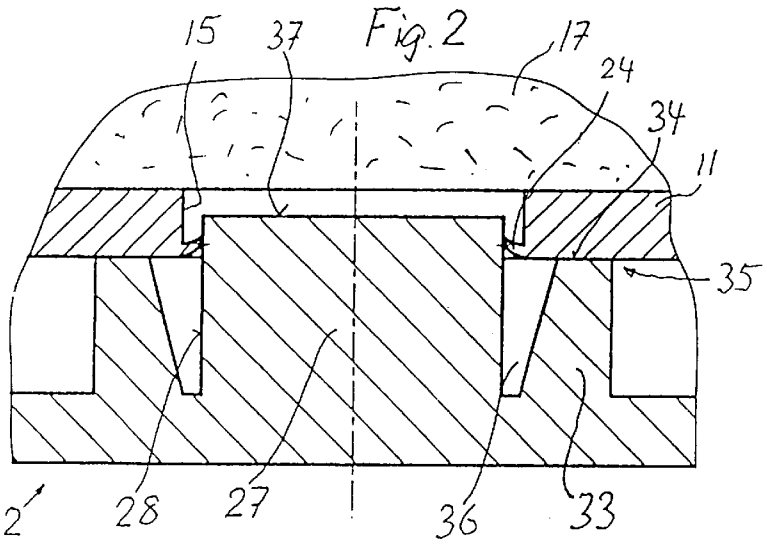
FIG. 2 shows an enlarged view of a portion of FIG. 1.
Figure 3:
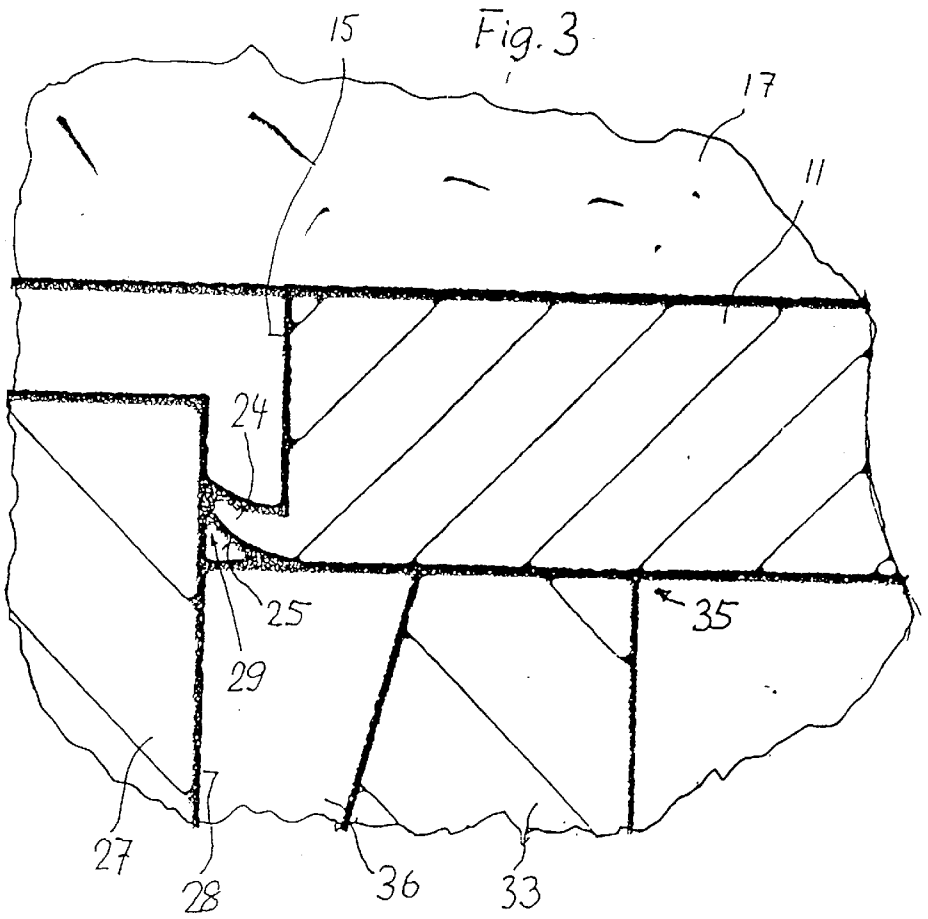
FIG. 3 shows an enlarged view of an outlet part shown in of FIG. 2.

Referring now to the drawings wherein the showings are for the purposes of illustrating the preferred embodiment of the invention only and not for purposes of limiting same, FIGS. 1–3 represent a cross section through an ink cartridge 1 having a transport guard 2. The cartridge 1 includes a housing 10 with a bottom wall 11, side walls 12 and a welded-on lid 13. The housing 10 is sub-divided into three chambers by means of two partitions 14. The wall 11 has one opening 15 per chamber for mounting each on a stub-like feed tube of a print head of an ink-jet printer (not shown). Each chamber 10 includes an ink impregnated foam body 17 of a selected color. While in operation, the underside of the foam body 17 is in contact with a screen, which overlies the stub of the print head.

As is apparent from FIGS. 2 and 3, at the lower edge of opening 15, at wall 11, there is molded on, in a single piece, a continuous annular sealing lip 24, oriented toward the center of opening 15. The inner edge of sealing lip 24 is cone-shaped in its relaxed, as molded, state. The guard 2 has a cylindrical element 27, whose outer diameter is a little larger than the inner diameter of sealing lip 24. When inserting the cartridge 1 into the guard 2, the inner edge of the lip 24 is, as a result, deformed in the upward direction. It is elastically pressed against the exterior surface 28 of cone 27 and thus forms a very narrow capillary gap. Should, however, a little ink escape from cartridge 1 during transport vibrations, it is held back through the capillary effect in the constantly downward widening gap 29 between the underside of lip 25 and the surface 28.

Cone 27 is surrounded by an annular projection 33 with flat frontal surface 34. Surface 34 is formed to engage against wall 11 making contact therewith when cartridge 1 is inserted in guard 2. Thus there is formed a second, narrow capillary sealing gap 35. Between the projection 33 and the element 27 there is formed an annular recess 36, which narrows toward the bottom of the recess. Should in the event of repeated strong jolts, some ink be shaken out of gap 29, despite the capillary effect, said ink, in turn, collects through capillary effect, at the bottom of recess 36.

The frontal surface 37 of element 27 protrudes into the opening 15, but does not touch the foam body 17.

In order to guaranty full abutment of wall 11 against frontal surface 34, the cartridge 1 is fitted into guard 2 by means of snap elements, which are identified in FIG. 1 with the numeral 38.

The described sealing of the opening 15 for transport is of extremely simple design and requires no additional elements such as O-rings, elastomer sealing strips, etc. Manufacturing and installation costs can thus be lowered. Since guard 2 contains no foreign parts, it can be disposed of in environmentally friendly fashion and can, for example, be recycled.

Figure 4:
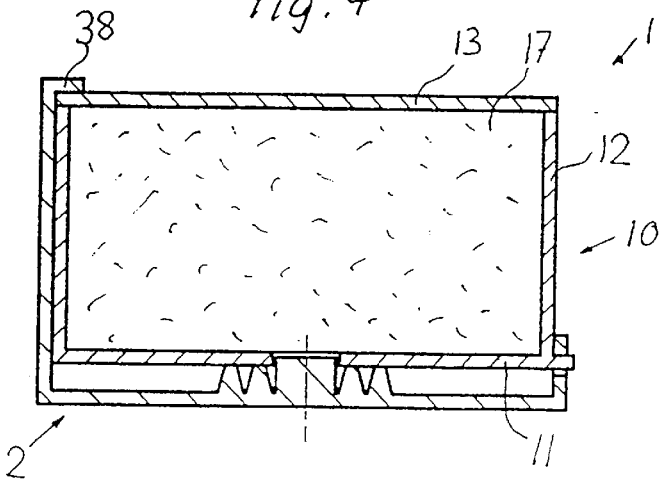
FIG. 4 is a cross section through a second specific embodiment.
Figure 5:
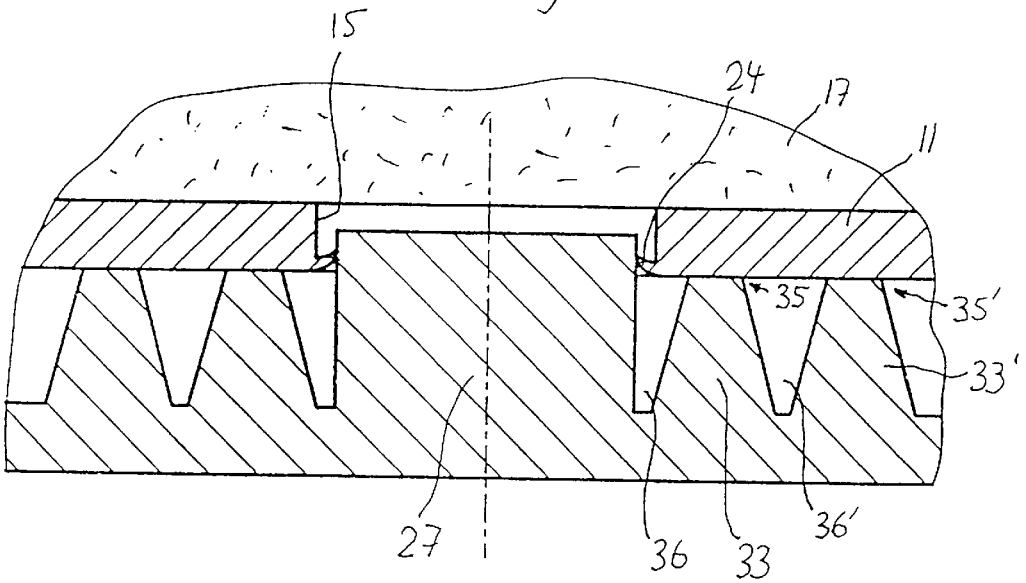
FIG. 5 is an enlarged view of an outlet part shown in FIG. 4.

The partitions 14 are omitted in the specific embodiment according to FIGS. 4 and 5. This cartridge is designed for a single-color print-head and, consequently, has only a single opening 15. The sealing of said opening is supplemented by means of another coaxial projection 33', which closes another, downwardly narrowing annular recess 36' and which forms another capillary gap 35' with wall 11.

Figure 6:
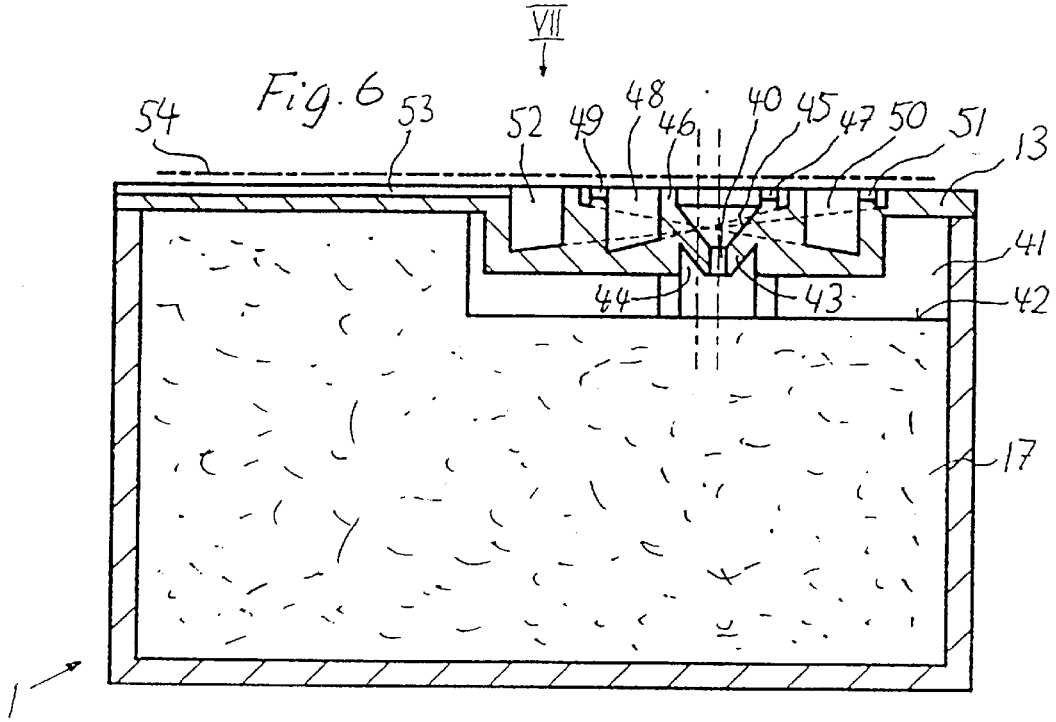
FIG. 6 is a cross section through the air supply opening.
Figure 7:
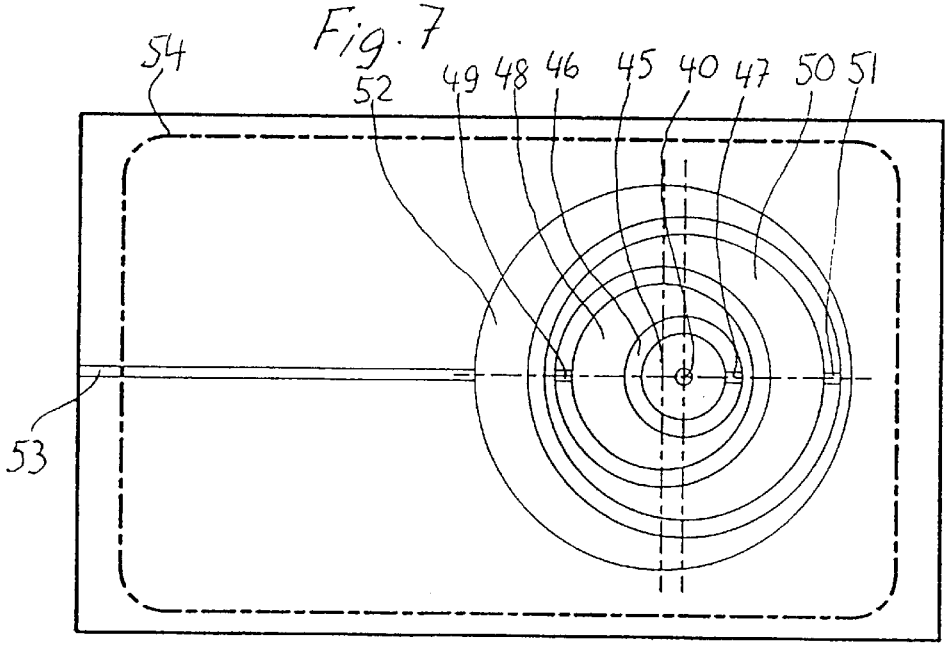
FIG. 7 is a top plan view in direction VII in FIG. 6.

In FIGS. 6 and 7, a magnified representation is shown of the air supply opening 40 in lid 13. It ends, on the inside, in a hollow open space 41, which is not filled by the foam body 17. In other words, around the opening 40, the upper side 42 of the foam body 17 is spaced from the lid 13. The opening 40 is designed as a cone-shaped projection 43 that tapers in the direction of surface 42. The projection 43 is surrounded by an annular recess 44, which narrows toward the bottom of the recess. The opening 40 issues, at the upper side of lid 13, in an upwardly funnel-shaped, widening depression 45 which is surrounded by an annular projection 46. The projection 46 has in one spot a channel 47, which connects the depression 45 with an annular space 48, surrounding the projection 46. The annular space 48 is connected at the location diametrically opposite channel 47 via another channel 49 with a second annular space 50 and it, in turn, connects at a diametrically opposite location via a third channel 51 with a third annular space 52. The annular space 52 at a location diametrically opposite channel 51 is connected with the atmosphere via a narrow, capillary, for example, meander-shaped groove 53. The annular spaces 48, 50, 52 widen respectively from the interior to the exterior channels 47, 49, 61 or to the groove 53, both with respect to depth as well as with respect to width. The depression 45, the annular spaces 48, 50, 52 and the channels 47, 49, 61 as well as the groove 53 are closed on top by means of a sealed-on foil 54. Groove 53 facilitates pressure compensation with fluctuating temperature or fluctuating pressure and while in operation during consumption of ink. Since it is long and narrow, evaporation losses are largely avoided.

As a result of the described design, there is produced, in this instance as well, a multi-step capillary seal against the exit of ink during transport vibrations. The entry of a mere droplet of ink into the opening 40, from space 41, is made more difficult by the conical projection 43. Ink, which hits the exterior surface of said projection 43 collects, due to capillary effect, at the bottom of recess 44. If, in spite of this, a droplet of ink escapes from opening 40, it is retained through the capillary effect of funnel 45 in the area of the mouth of opening 40. Should, in spite of this, ink get via channel 47 into space 48, then the space 48, which enlarges on both sides from the direction of channel 47, causes the ink to be held back in the area of channel 47 due to capillary effect and, if needed, is sucked back into same. The other two annular spaces 50, 52 have the same effect. Consequently, it is practically impossible for ink to reach groove 53. Here, as well, based on simple design, effective sealing is achieved against escape of ink due to transport vibrations.

Based on production engineering methods, the upper edges 57 of channels 47, 49, 51 of the annular spaces 48, 50, 52 and of groove 53 cannot be formed with sharp edges. Through interaction with the sealed-on foil 54 there is thus produced, along said edge 57, a very narrow capillary gap. In order to prevent expansion of eventually escaped ink alongside said capillary gap up to the edge to foil 54, in the specific embodiments according to FIG. 8 to 12, the one end of the capillary groove 53 adjacent to foil 54 issues at the periphery 60 of an annularly closed additional annular space 58, which does not have any capillary restrictions in the area of said periphery 60.

Figure 8:
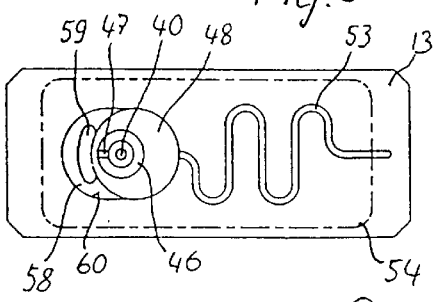
FIGS. 8–12 show additional specific embodiments.
Figure 11:
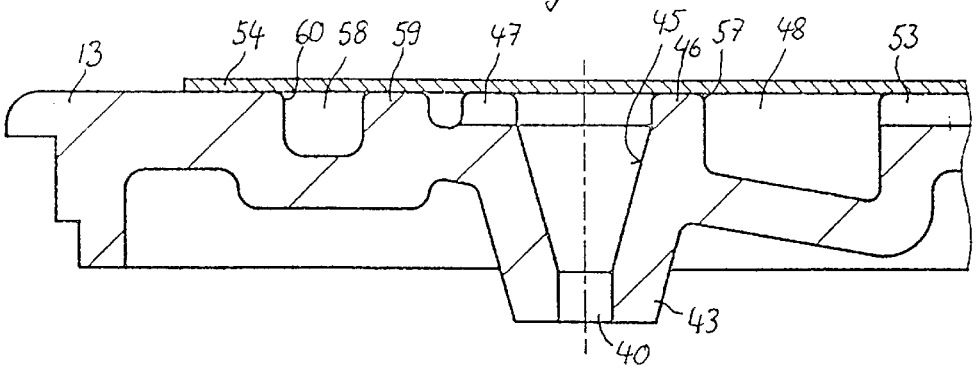
Figure 12:
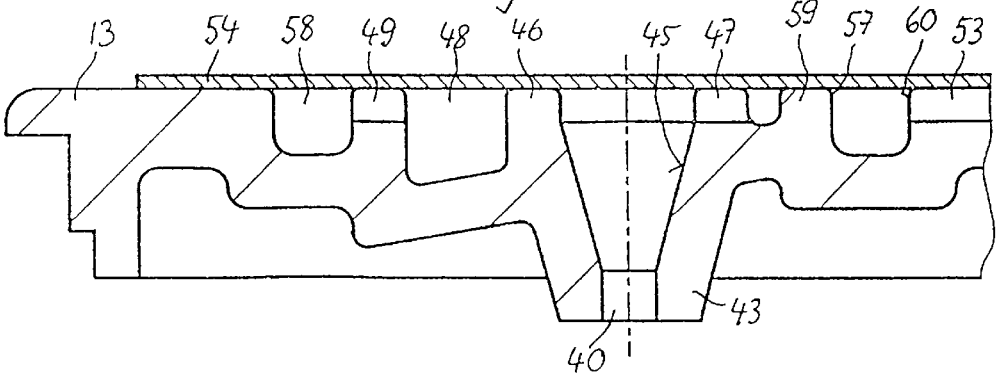

In the specific embodiment according to FIGS. 8 and 11, there is formed, opposite channel 47, onto lid 13, another circular segment-shaped projection 59. The capillary trap for retaining any potentially escaped ink extends only in the area between the projections 46, 59. In case any ink should accumulate there, it can only expand alongside the capillary gap between foil 54 and the edges 57, and along the projections 46, 59. In contrast thereto, the space 58 next to the projection 59, is depressed, so that the ink caught in the capillary trap adjacent to channel 47 cannot reach the periphery 60, into which issues groove 53. As a result, escape of ink alongside the capillary gap at the upper edge of the groove is prevented.

Figure 9:
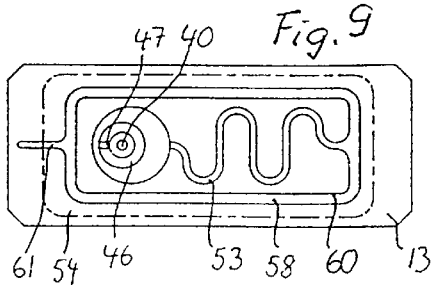
Figure 10:
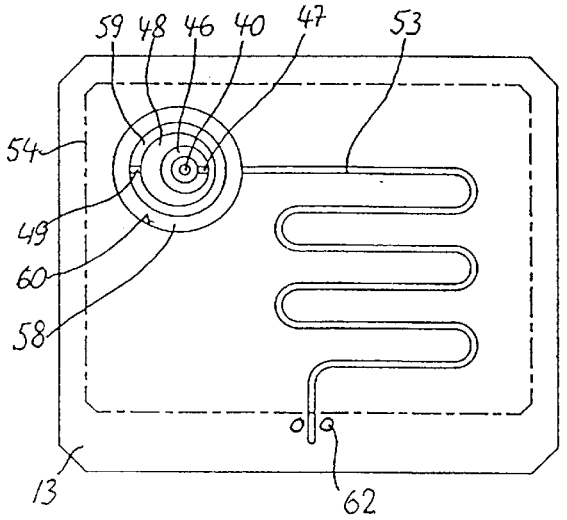

In the specific embodiment according to FIG. 9, it is possible for the ink to creep along the capillary gap of the upper edge of the groove. But it cannot jump across the recessed annular space 58 and thus cannot reach the capillary groove 61 leading to the outside. In the specific embodiment according to FIGS. 10 and 12, the shape of the projection 59 is circular and has another channel 49. The annular space 58 however, does not have any restriction adjacent to said channel 49. Consequently, skipping of ink across to the periphery 60 is, in turn, prevented.

At the location where the groove 53 appears from under foil 54, there may be formed onto the lid 13, on both sides of grooves 53, small protruding nubs 62. This prevents that at that location a packing foil may be positioned flat on foil 54 and that thus another capillary gap is formed between said foil 54 and the packing foil, in which there could be a real creep of ink.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An apparatus having an ink cartridge and a transport guard connected to the ink cartridge for a print head of an ink-jet printer, the ink cartridge comprising a housing having a first opening for placement onto a feed tube projecting from the print head and a second opening for supplying air to an interior of the housing, the transport guard closing the first opening and being removable, the improvement comprising:

a plurality of cascading capillary seals annularly formed around at least one of the first and second openings between the transport guard and the ink cartridge, an annular sealing lip projecting from an edge of the first opening and toward a center of the first opening, and a protruding element projecting from the transport guard adapted for insertion into the first opening upon connecting the transport guard to the ink cartridge, the protruding element including a circumferential surface for sealingly engaging the annular sealing lip to prevent ink from exiting the first opening.

2. The cartridge and a transport guard according to claim 1 wherein the sealing lip narrows in size towards the center of the first opening.

3. The cartridge and a transport guard according to claim 1 wherein the transport guard further includes an annular projection (33) projecting therefrom and surrounding the protruding element, the annular projection having a frontal surface (34) for engaging the ink cartridge adjacent the first opening and forming a seal therebetween, the annular projection projecting out from the transport guard a distance being less than a distance which the protruding element (27) projects from the transport guard.

4. The ink cartridge and a transport guard according to claim 3 wherein the protruding (27) and the annular projection (33) define an annular recess (36) therebetween which narrows toward a bottom of the recess.

5. The ink cartridge and a transport guard according to claim 1 wherein the transport guard (2) further includes a snap element for connecting the transport guard to the ink cartridge.

6. In combination, an ink cartridge and a cover lid for a print head of an ink-jet printer, the ink cartridge comprising a housing for retaining ink and having a first opening for placement onto a feed tube projecting from the print head and a second opening extending through the housing for supplying air to an interior of the housing, the cover lid being sealingly attached on an outer surface of the housing over the second opening to prevent leakage of ink, the improvement comprising:

the second opening being formed generally in a cone shape enlarging toward the outer surface of the housing;

a space formed between the cover lid and the housing adjacent the second opening for collecting fluid;

an annular projection formed on the housing between the second opening and the space and surrounding the second opening, the annular projection forming a capillary seal against the cover lid and includes a channel formed therethrough to provide fluid communication between the second opening and the space such that the space is adapted to collect fluid exiting from the second opening; and a capillary groove formed on the housing between the cover lid and the housing, the capillary groove having a first end connected with the space and a second end exposed to atmosphere.

7. The ink cartridge according to claim 6 wherein the space increases in size along a portion of the space adjacent the capillary groove.

8. The ink cartridge according to claim 7 wherein the portion of the space comprises at least one additional channel (49) which connects with a further space (50) increasing in cross section from a connecting channel to the space.

9. The ink cartridge according to claim 6 where an end of the capillary groove (53) opens into an annularly-shaped, closed periphery (60) of one of the space and the further space which has no capillary restrictions in said periphery (60).

10. The ink cartridge as set forth in claim 1 further including a plurality of recesses each defined around the port.

11. The ink cartridge as set forth in claim 10 wherein the plurality of recesses are interconnected allowing fluid communication between each of the plurality of recesses.

12. The ink cartridge as set forth in claim 1 wherein the removable sealing member is configured for attachment to the housing by frictional engagement with the housing and further comprises:

a first projecting element projecting from the sealing member and being positioned and dimensioned to project into the port upon attachment of the sealing member to the housing wherein the port is defined by an edge of the housing, the first projecting element being sized to engage all portions of the edge of the port forming a first seal such that ink is restricted from exiting the port; and a second projecting element projecting from the sealing member and being annularly disposed around the first projecting element, the second projecting element being dimensioned to engage the housing adjacent the port upon attachment of the sealing member to the housing forming a second seal around the port, the first and second projecting elements being spaced apart to define the recess therebetween.

13. The ink cartridge as set forth in claim 12 wherein the edge of the port includes a sealing lip projecting therefrom toward a center of the port, the first projecting element engaging the sealing lip upon insertion into the port.

14. The ink cartridge as set forth in claim 12 wherein the recess is formed on the housing around the port.

* * * * *